US011466633B1

(12) United States Patent
Martz et al.

(10) Patent No.: US 11,466,633 B1
(45) Date of Patent: Oct. 11, 2022

(54) METHOD AND SYSTEM FOR PREPARING AN ENGINE FOR STARTING

(71) Applicant: Ford Global Technologies, LLC, Dearborn, MI (US)

(72) Inventors: Jason Martz, Canton, MI (US); Eric Matthew Kurtz, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/456,211

(22) Filed: Nov. 23, 2021

(51) Int. Cl.

| | |
|---|---|
| ***F02D 41/06*** | (2006.01) |
| ***F02D 41/02*** | (2006.01) |
| ***F02D 41/08*** | (2006.01) |
| ***F02D 41/00*** | (2006.01) |

(52) U.S. Cl.
CPC ..... *F02D 41/0255* (2013.01); *F02D 41/0002* (2013.01); *F02D 41/08* (2013.01); *F02D 2041/001* (2013.01); *F02D 2200/0802* (2013.01); *F02D 2200/604* (2013.01); *F02D 2200/70* (2013.01)

(58) Field of Classification Search
CPC .. F02D 41/0255; F02D 41/0002; F02D 41/08; F02D 2041/001; F02D 2200/0802; F02D 2200/604; F02D 2200/70
USPC ..... 701/103, 112, 113; 123/564, 685, 676, 123/672, 399, 481, 491; 290/40 R
See application file for complete search history.

(56) References Cited

U.S. PATENT DOCUMENTS

| | | | | |
|---|---|---|---|---|
| 9,925,974 | B2 | 3/2018 | Leone et al. | |
| 10,626,816 | B2 | 4/2020 | Sumilla et al. | |
| 10,677,172 | B2 | 6/2020 | Ulrey et al. | |
| 10,882,511 | B2 | 1/2021 | Ulrey et al. | |
| 2019/0345857 | A1* | 11/2019 | Rollinger | F01N 3/30 |
| 2020/0116061 | A1 | 4/2020 | Hupfeld et al. | |

FOREIGN PATENT DOCUMENTS

| | | | |
|---|---|---|---|
| GB | 2581774 | B | 9/2021 |

OTHER PUBLICATIONS

Martz, J. et al., "Methods and Systems for Engine Exhaust Catalyst Operations," U.S. Appl. No. 17/444,471, filed Aug. 4, 2021, 42 pages.

* cited by examiner

*Primary Examiner* — Hai H Huynh
(74) *Attorney, Agent, or Firm* — Vincent Mastrogiacomo; McCoy Russell LLP

(57) ABSTRACT

Methods and systems are provided for heating a catalyst via a catalyst heater are presented. In one example, the catalyst may be heated to provide a minimum amount of time for the catalyst to reach a threshold temperature. In another example, the catalyst heater may be heated to minimize an amount of power that is used to heat the catalyst.

20 Claims, 5 Drawing Sheets

METHOD AND SYSTEM FOR PREPARING AN ENGINE FOR STARTING

FIELD

The present application relates to methods and systems for cold starting an internal combustion engine.

BACKGROUND/SUMMARY

An internal combustion engine may be turned off for longer periods of time such that a temperature of the engine approaches ambient air temperature. The engine may be started (e.g., cold started) during these conditions and the engine may tend to generate higher concentration levels of hydrocarbons (HC) and carbon monoxide (CO) during these conditions. The engine may be operated to generate higher levels of heat when it is cold started so that a catalyst in the engine's exhaust system may light-off sooner, thereby reducing engine tailpipe emissions. However, the catalyst may not reach light off temperature as soon as may be desired even when the engine is producing higher levels of heat. Therefore, an electrically heated catalyst may be utilized to reduce an amount of time it may take to reach light-off temperature. Nevertheless, engine exhaust emissions may pass through the electrically heated catalyst after the engine is started because the catalyst may not reach a light-off temperature soon enough to process the engine exhaust emissions.

The inventors herein have recognized that engine exhaust emissions may be higher than may be desired even when an electrically heated catalyst is applied to process engine exhaust gases. Therefore, the inventors have developed a method for operating an engine, comprising: activating an electrically powered heater in an engine exhaust system and operating the electrically driven heater at substantially full power; rotating an engine without supplying fuel to the engine; and adjusting an amount of air flow through the engine such that a target temperature is achieved at an inlet of a catalyst.

By operating a catalyst heater at substantially full input power and rotating an engine without supplying fuel to the engine, it may be possible to raise catalyst temperature in a short or minimum amount of time so that the catalyst may process engine exhaust emissions at a high efficiency level. In addition, vehicle users may not be subject to a long wait time before they may proceed on a trip. In this way, a catalyst may be heated rapidly for short notice travel plans.

In addition, the present approach also provides for heating a catalyst with a minimum amount of power so as to conserve power. In one example, the engine may be rotated at a low speed without fuel injected to the engine while power that is supplied to a catalyst heater is adjusted to raise a temperature at an inlet of the catalyst at a controlled rate so that heat transfer between the air that flows through the catalyst heating element and the catalyst may be improved. Thus, the present approach is not limited to a single way of heating a catalyst.

The present description may provide several advantages. In particular, the approach may reduce engine emissions. Further, the approach may reduce an amount of time it takes for a catalyst to reach a threshold temperature. In addition, the approach may be applied to conserve power applied to heat a catalyst.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
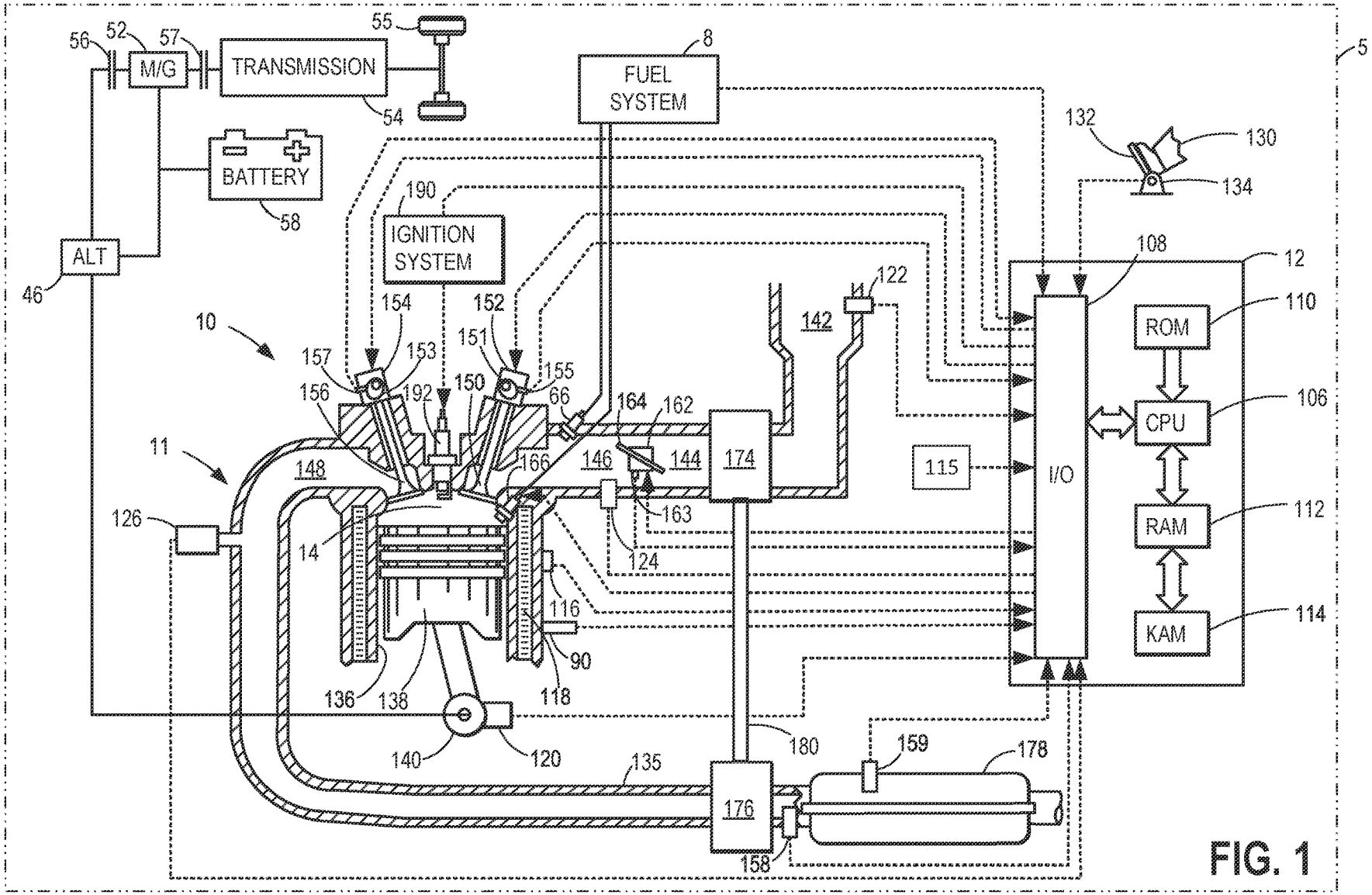
FIG. 1 shows a schematic depiction of an engine system of a vehicle.
Figure 2:
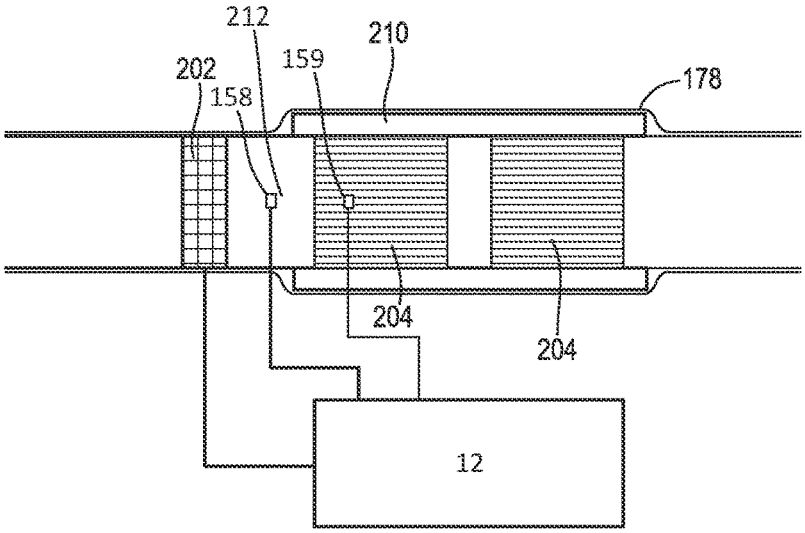
FIGS. 2 and 3 show example catalyst heating sequences according to the method of FIGS. 4 and 5.
Figure 2:
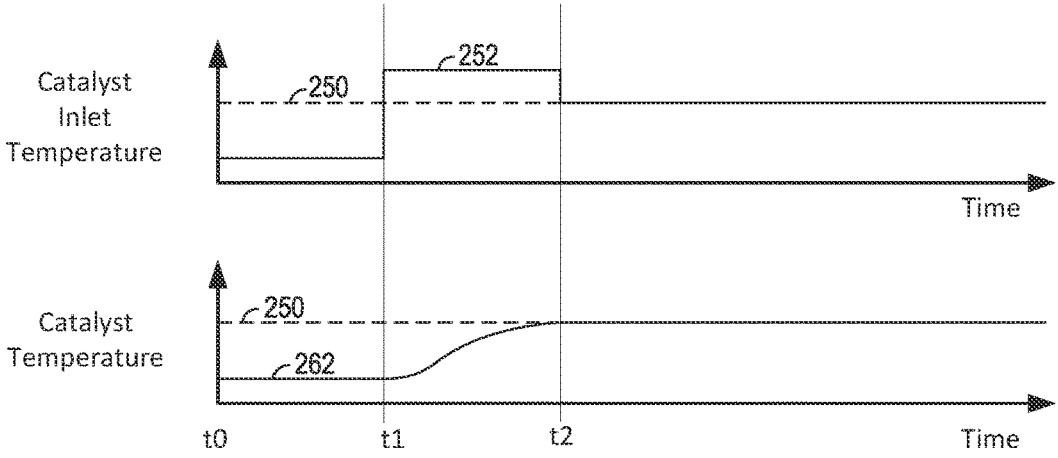
Figure 3:
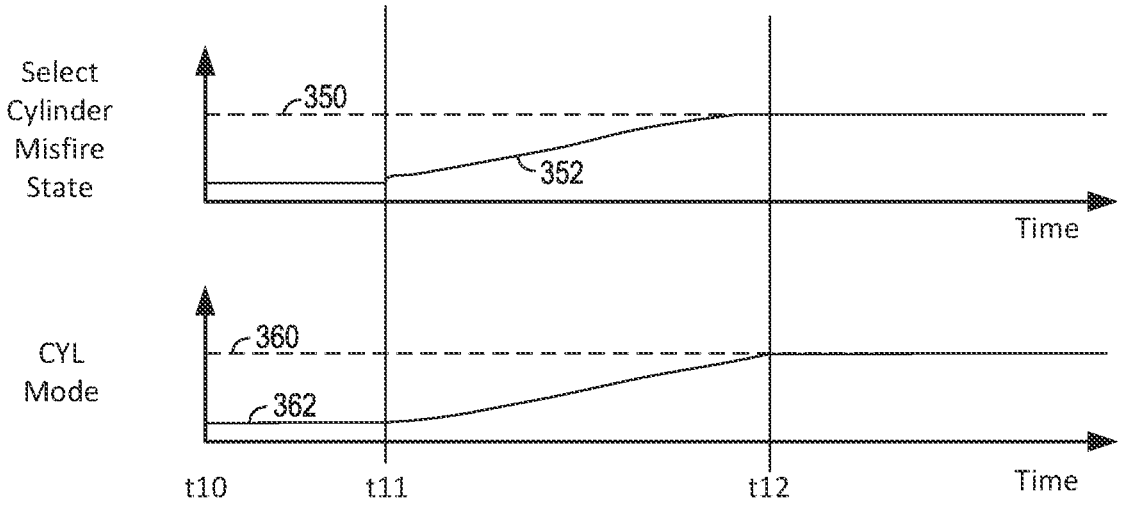
Figure 4:
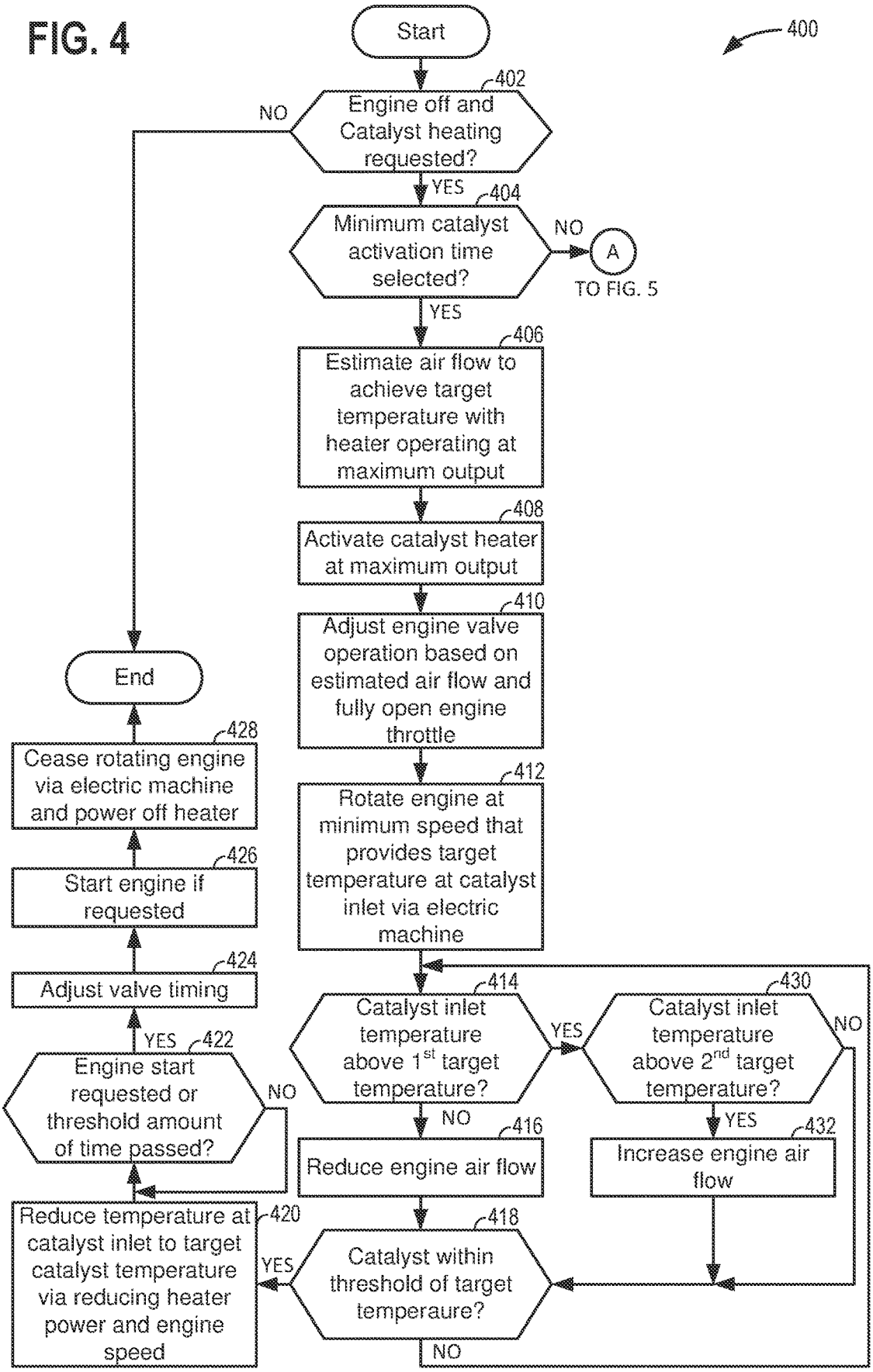
FIGS. 4 and 5 shows a flow chart of a method for heating a catalyst for processing exhaust emissions of an internal combustion engine.
Figure 5:
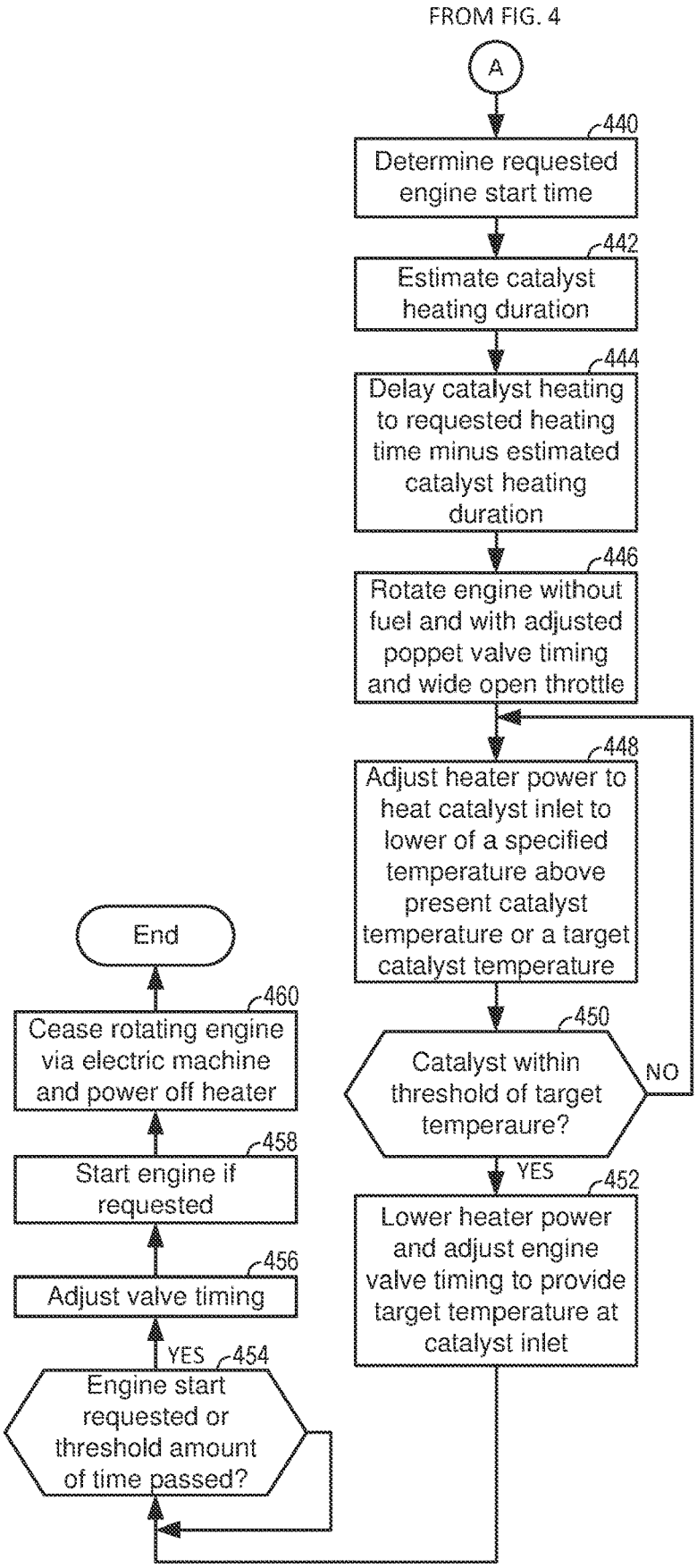

The following description relates to systems and methods for heating a catalyst located in an exhaust system of an internal combustion engine. The catalyst may be heated via an electrically heated catalyst or via a heater that combusts a fuel. The catalyst may process exhaust gases from a gasoline or diesel engine. The catalyst may be included in a hybrid vehicle as shown in FIG. 1. FIGS. 2 and 3 show different catalyst heating sequences according to the method of FIGS. 4 and 5. A method for heating a catalyst to process engine emissions is shown in FIGS. 4 and 5.

Turning now to the figures, FIG. 1 depicts an example of a cylinder 14 of an internal combustion engine 10, which may be included in a vehicle 5. Engine 10 may be a variable displacement engine (VDE), as described further below. Engine 10 may be controlled at least partially by a control system, including a controller 12, and by input from a human vehicle operator 130 via a driver demand pedal 132. In this example, driver demand pedal 132 includes a pedal position sensor 134 for generating a proportional pedal position signal. Cylinder (herein, also "combustion chamber") 14 of engine 10 may include combustion chamber walls 136 with a piston 138 positioned therein. Piston 138 may be coupled to a crankshaft 140 so that reciprocating motion of the piston is translated into rotational motion of the crankshaft. Crankshaft 140 may be coupled to at least one vehicle wheel 55 of vehicle 5 via a transmission 54, as further described below.

In some examples, vehicle 5 may be a hybrid vehicle with multiple sources of torque available to one or more vehicle wheels 55. In other examples, vehicle 5 is a conventional vehicle with only an engine or an electric vehicle with only an electric machine(s). In the example shown, vehicle 5 includes engine 10 and an electric machine 52. Electric machine 52 may be a motor or a motor/generator. Crankshaft 140 of engine 10 and electric machine 52 are connected via transmission 54 to vehicle wheels 55 when one or more clutches 56 are engaged. In the depicted example, a first clutch 56 is provided between crankshaft 140 and electric machine 52, and a second clutch 57 is provided between electric machine 52 and transmission 54. Controller 12 may send a signal to an actuator of each clutch 56 to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission.

Engine 10 may be rotated via electric machine 52 during starting or when engine 10 is operated as an air pump. Alternatively, a starter motor (not shown) may rotate engine 10 during starting or when engine 10 is operated as an air pump. The starter motor may engage crankshaft 140 via a flywheel (not shown).

The powertrain may be configured in various manners, including as a parallel, a series, or a series-parallel hybrid vehicle. Further, engine 10 and electric machine 52 may be coupled via a gear set instead of a clutch in some configurations. In electric vehicle examples, a system battery 58 may be a traction battery that delivers electrical power to electric machine 52 to provide torque to vehicle wheels 55. In some examples, electric machine 52 may also be operated as a generator to provide electrical power to charge system battery 58, for example, during a braking operation. It will be appreciated that in other examples, including non-electric vehicle examples, system battery 58 may be a typical starting, lighting, ignition (SLI) battery coupled to an alternator 46.

Alternator 46 may be configured to charge system battery 58 using engine torque via crankshaft 140 during engine running. In addition, alternator 46 may power one or more electrical systems of the engine, such as one or more auxiliary systems including a heating, ventilation, and air conditioning (HVAC) system, vehicle lights, an on-board entertainment system, and other auxiliary systems based on their corresponding electrical demands. In one example, a current drawn on the alternator may continually vary based on each of an operator cabin cooling demand, a battery charging requirement, other auxiliary vehicle system demands, and motor torque. A voltage regulator may be coupled to alternator 46 in order to regulate the power output of the alternator based upon system usage requirements, including auxiliary system demands.

Cylinder 14 of engine 10 can receive intake air via a series of intake passages 142 and 144 and an intake manifold 146. Intake manifold 146 can communicate with other cylinders of engine 10 in addition to cylinder 14. One or more of the intake passages may include one or more boosting devices, such as a turbocharger or a supercharger. For example, FIG. 1 shows engine 10 configured with a turbocharger, including a compressor 174 arranged between intake passages 142 and 144 and an exhaust turbine 176 arranged along an exhaust passage 135. Compressor 174 may be at least partially powered by exhaust turbine 176 via a shaft 180 when the boosting device is configured as a turbocharger. However, in other examples, such as when engine 10 is provided with a supercharger, compressor 174 may be powered by mechanical input from a motor or the engine and exhaust turbine 176 may be optionally omitted. In still other examples, engine 10 may be provided with an electric supercharger (e.g., an "eBooster"), and compressor 174 may be driven by an electric motor. In still other examples, engine 10 may not be provided with a boosting device, such as when engine 10 is a naturally aspirated engine.

A throttle 162 including a throttle plate 164 may be provided in the engine intake passages for varying a flow rate and/or pressure of intake air provided to the engine cylinders. For example, throttle 162 may be positioned downstream of compressor 174, as shown in FIG. 1, or may be alternatively provided upstream of compressor 174. A position of throttle 162 may be communicated to controller 12 via a signal from a throttle position sensor.

An exhaust manifold 148 can receive exhaust gases from other cylinders of engine 10 in addition to cylinder 14. An exhaust gas sensor 126 is shown coupled to exhaust manifold 148 upstream of an emission control device 178. Exhaust gas sensor 126 may be selected from among various suitable sensors for providing an indication of an exhaust gas air/fuel ratio (AFR), such as a linear oxygen sensor or UEGO (universal or wide-range exhaust gas oxygen), a two-state oxygen sensor or EGO, a HEGO (heated EGO), a NOx, a HC, or a CO sensor, for example. In the example of FIG. 1, exhaust gas sensor 126 is a UEGO sensor. Emission control device 178 may be a three-way catalyst, a NOx trap, various other emission control devices, or combinations thereof. In the example of FIG. 1, emission control device 178 may be a three-way catalyst or an oxidation catalyst. Exhaust manifold 148, emissions control device 178, exhaust gas sensor 126, and temperature sensors may be included in engine exhaust system 11.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder. In this example, intake valve 150 may be controlled by controller 12 by cam actuation via cam actuation system 152, including one or more cams 151. Similarly, exhaust valve 156 may be controlled by controller 12 via cam actuation system 154, including one or more cams 153. The position of intake valve 150 and exhaust valve 156 may be determined by valve position sensors (not shown) and/or camshaft position sensors 155 and 157, respectively.

During some conditions, controller 12 may vary the signals provided to cam actuation systems 152 and 154 to control the opening and closing of the respective intake and exhaust valves. The intake and exhaust valve timing may be controlled concurrently, or any of a possibility of variable intake cam timing, variable exhaust cam timing, dual independent variable cam timing, or fixed cam timing may be used. Each cam actuation system may include one or more cams and may utilize one or more of variable displacement engine (VDE), cam profile switching (CPS), variable cam timing (VCT), variable valve timing (VVT), and/or variable valve lift (VVL) systems that may be operated by controller 12 to vary valve operation. In alternative examples, intake valve 150 and/or exhaust valve 156 may be controlled by electric valve actuation. For example, cylinder 14 may alternatively include an intake valve controlled via electric valve actuation and an exhaust valve controlled via cam actuation, including CPS and/or VCT systems. In other examples, the intake and exhaust valves may be controlled by a common valve actuator (or actuation system) or a variable valve timing actuator (or actuation system).

As further described herein, intake valve 150 and exhaust valve 156 may be deactivated during VDE mode via electrically actuated rocker arm mechanisms. In another example, intake valve 150 and exhaust valve 156 may be deactivated via a CPS mechanism in which a cam lobe with no lift is used for deactivated valves. Still other valve deactivation mechanisms may also be used, such as for electrically actuated valves. In one example, deactivation of intake valve 150 may be controlled by a first VDE actuator (e.g., a first electrically actuated rocker arm mechanism, coupled to intake valve 150) while deactivation of exhaust valve 156 may be controlled by a second VDE actuator (e.g., a second electrically actuated rocker arm mechanism, coupled to exhaust valve 156). In alternate examples, a single VDE actuator may control deactivation of both intake and exhaust valves of the cylinder. In still other examples, a single cylinder valve actuator deactivates a plurality of cylinders (both intake and exhaust valves), such as all of the cylinders in an engine bank, or a distinct actuator may control deactivation for all of the intake valves while another distinct actuator controls deactivation for all of the exhaust valves of the deactivated cylinders. It will be appreciated that if the cylinder is a non-deactivatable cylinder of the VDE engine, then the cylinder may not have any valve deactivating actuators. Each engine cylinder may include the valve control mechanisms described herein. Intake and exhaust valves are held in closed positions over one or more engine cycles when deactivated so as to prevent flow into or out of cylinder 14.

Cylinder 14 can have a compression ratio, which is a ratio of volumes when piston 138 is at bottom dead center (BDC) to top dead center (TDC). In one example, the compression ratio is in the range of 9:1 to 22:1, depending on whether engine 10 is configured as a gasoline or diesel engine. The compression ratio may also be increased if direct injection is used due to its effect on engine knock.

Each cylinder of engine 10 may include a spark plug 192 for initiating combustion when the engine is configured to combust gasoline or petrol. However, spark plug 192 may be omitted when engine 10 is configured to combust diesel fuel. An ignition system 190 can provide an ignition spark to combustion chamber 14 via spark plug 192 in response to a spark advance signal from controller 12, under select operating modes. Spark timing may be adjusted based on engine operating conditions and driver torque demand. For example, spark may be provided at minimum spark advance for best torque (MBT) timing to maximize engine power and efficiency. Controller 12 may input engine operating conditions, including engine speed, engine load, and exhaust gas AFR, into a look-up table and output the corresponding MBT timing for the input engine operating conditions. In other examples, spark may be retarded from MBT, such as to expedite catalyst warm-up during engine start or to reduce an occurrence of engine knock.

In some examples, each cylinder of engine 10 may be configured with one or more fuel injectors for providing fuel thereto. As a non-limiting example, cylinder 14 is shown including a direct fuel injector 166 and a port fuel injector 66. Fuel injectors 166 and 66 may be configured to deliver fuel received from a fuel system 8. Fuel system 8 may include one or more fuel tanks, fuel pumps, and fuel rails. Fuel injector 166 is shown coupled directly to cylinder 14 for injecting fuel directly therein in proportion to a pulse width of a signal received from controller 12. Port fuel injector 66 may be controlled by controller 12 in a similar way. In this manner, fuel injector 166 provides what is known as direct injection (hereafter also referred to as "DI") of fuel into cylinder 14. While FIG. 1 shows fuel injector 166 positioned to one side of cylinder 14, fuel injector 166 may alternatively be located overhead of the piston, such as near the position of spark plug 192. Such a position may increase mixing and combustion when operating the engine with an alcohol-based fuel due to the lower volatility of some alcohol-based fuels. Alternatively, the injector may be located overhead and near the intake valve to increase mixing. Fuel may be delivered to fuel injectors 166 and 66 from a fuel tank of fuel system 8 via fuel pumps and fuel rails. Further, the fuel tank may have a pressure transducer providing a signal to controller 12.

Fuel injectors 166 and 66 may be configured to receive different fuels from fuel system 8 in varying relative amounts as a fuel mixture and further configured to inject this fuel mixture directly into cylinder. For example, fuel injector 166 may receive alcohol fuel and fuel injector 66 may receive gasoline. Further, fuel may be delivered to cylinder 14 during different strokes of a single cycle of the cylinder. For example, directly injected fuel may be delivered at least partially during a previous exhaust stroke, during an intake stroke, and/or during a compression stroke. Port injected fuel may be injected after intake valve closing of a previous cycle of the cylinder receiving fuel and up until intake valve closing of the present cylinder cycle. As such, for a single combustion event (e.g., combustion of fuel in the cylinder via spark ignition or compression ignition), one or multiple injections of fuel may be performed per cycle via either or both injectors. The multiple DI injections may be performed during the compression stroke, intake stroke, or any appropriate combination thereof in what is referred to as split fuel injection.

Controller 12 is shown in FIG. 1 as a microcomputer, including a microprocessor unit 106, input/output ports 108, an electronic storage medium for executable programs (e.g., executable instructions) and calibration values shown as non-transitory read-only memory chip 110 in this particular example, random access memory 112, keep alive memory 114, and a data bus. Controller 12 may receive various signals from sensors coupled to engine 10, including signals previously discussed and additionally including a measurement of inducted mass air flow (MAF) from a mass air flow sensor 122; an engine coolant temperature (ECT) from a temperature sensor 116 coupled to a cooling sleeve 118; a catalyst inlet temperature from a temperature sensor 158 coupled to exhaust passage 135; a catalyst temperature from temperature sensor 159; a crankshaft position signal from a Hall effect sensor 120 (or other type) coupled to crankshaft 140; throttle position from a throttle position sensor 163; signal UEGO from exhaust gas sensor 126, which may be used by controller 12 to determine the air-fuel ratio of the exhaust gas; engine vibrations via sensor 90; and an absolute manifold pressure signal (MAP) from a MAP sensor 124. An engine speed signal, RPM, may be generated by controller 12 from crankshaft position. The manifold pressure signal MAP from MAP sensor 124 may be used to provide an indication of vacuum or pressure in the intake manifold. Controller 12 may infer an engine temperature based on the engine coolant temperature.

Controller 12 receives signals from the various sensors of FIG. 1 and employs the various actuators of FIG. 1 to adjust engine operation based on the received signals and instructions stored on a memory of the controller. For example, the controller may transition the engine to operating in VDE mode by actuating valve actuators 152 and 154 to deactivate selected cylinders. In addition, controller 12 may receive input from and provide data to human/machine interface 115. In one example, human/machine interface 115 may be a touch screen device, a display and keyboard, a phone, or other known device.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

During selected conditions, such as when the full torque capability of engine 10 is not requested, one of a first or a second cylinder group may be selected for deactivation by controller 12 (herein also referred to as a VDE mode of operation). During the VDE mode, cylinders of the selected group of cylinders may be deactivated by shutting off respective fuel injectors 166 and 66. Further, valves 150 and 156 may be deactivated and held closed over one or more entire engine cycles. While fuel injectors of the disabled cylinders are turned off, the remaining enabled cylinders continue to carry out combustion, with corresponding fuel injectors and intake and exhaust valves active and operating. To meet torque requirements, the controller adjusts the amount of air entering active engine cylinders. Thus, to provide equivalent engine torque that an eight cylinder engine produces at 0.2 engine load and a particular engine speed, the active engine cylinders may operate at higher pressures than engine cylinders when the engine is operated with all engine cylinders being active. This requires higher manifold pressures, resulting in lowered pumping losses and increased engine efficiency. Additionally, the lower effective surface area (from only the active cylinders) exposed to combustion reduces engine heat losses, increasing the thermal efficiency of the engine.

Thus, the system of FIG. 1 provides for a system for operating an engine, comprising: an internal combustion engine including a catalyst and a catalyst heater; and a controller including executable instructions stored in non-transitory memory that cause the controller to minimize an amount of time to heat a catalyst to a threshold temperature in a first mode, and additional instructions that cause the controller to minimize an amount of power to heat the catalyst to a threshold temperature in a second mode, the amount of time minimized by adjusting an amount of air flow through the internal combustion engine while operating the catalyst heater with a substantially constant amount of electrical power (e.g., with a catalyst heater input power that varies by less than +10% during a predetermined period of time, such as one minute). The system includes where the amount of power is minimized via adjusting a target catalyst inlet temperature based on a present catalyst temperature. The system includes where the amount of power is minimized via rotating the engine at a speed that is below an engine idle speed. The system further comprises additional instructions to adjust a target catalyst inlet temperature based on a temperature at which a phase change material changes phase. The system includes where the first mode and the second mode may be selected via a user input. The system includes where the amount of air is adjusted to produce a target temperature at an inlet of the catalyst. The system includes where the substantially constant amount of electrical power is the maximum rated power of the catalyst heater. The system further comprises additional instructions to adjust a target temperature at an inlet of the catalyst after the catalyst reaches a threshold temperature to a temperature that is based on a property of a phase changing material.

Referring now to FIG. 2, an example engine operating sequence according to the method of FIGS. 4 and 5 is shown. In addition, FIG. 2 includes detailed view of catalyst 178 shown in FIG. 1. The sequence of FIG. 2 may be provided via the system of FIG. 1 in cooperation with the method of FIGS. 4 and 5.

Catalyst 178 includes two catalyst substrates 204 that support a washcoat that may include a mixture of that may be comprised of two or more of ceria, platinum, palladium, copper, iron, and rhodium. Optionally, a phase changing material 210 may be wrapped around substrates 204 to absorb and release heat energy to maintain catalyst temperature. Phase change material may change from a solid state to a liquid state when the phase change material is heated above a threshold temperature. Temperature sensor 158 senses a temperature at catalyst inlet 212 and temperature sensor 159 senses catalyst temperature with a catalyst substrate 204. Catalyst heater 202 may be electrically heated or heated via a combustor (not shown). Controller 12 may selectively activate and deactivate catalyst heater 202.

The first plot from the top of FIG. 2 is a plot of catalyst inlet temperature versus time. The vertical axis represents catalyst inlet temperature and the catalyst inlet temperature increases in the direction of the vertical axis arrow. The horizontal axis represents time and time increases from the left side of the figure to the right side of the figure. Trace 252 represents the catalyst inlet temperature. Dashed line 250 represents a target catalyst temperature.

The second plot from the top of FIG. 2 is a plot of catalyst temperature versus time. The vertical axis represents catalyst temperature and the catalyst temperature increases in the direction of the vertical axis arrow. The horizontal axis represents time and time increases from the left side of the figure to the right side of the figure. Trace 262 represents the catalyst temperature. Dashed line 250 represents a target catalyst temperature.

At time t0, the catalyst temperature and the catalyst inlet temperature are low (e.g., at ambient air temperature). The engine (not shown) is not operating or rotating and fuel is not being injected into the engine (not shown). There is no indication of an impending engine start, nor is there a request to warm the catalyst in advance of an impending engine start.

At time t1, a request to heat the catalyst in a minimum amount of time is generated (not shown). The catalyst heater is activated (e.g., fuel or electrical energy is supplied to the catalyst heater) and the engine begins to be rotated without fuel being supplied to the engine (not shown). The catalyst heater is operated at its maximum input power limit (not shown) and the engine is rotated at a speed where it pumps air at a rate such that a target catalyst inlet temperature is reached (not shown). The target catalyst inlet temperature is greater than the target catalyst temperature. The catalyst temperature begins to rise shortly thereafter.

At time t2, the catalyst temperature reaches the target catalyst temperature so the target catalyst inlet temperature is reduced to the target catalyst temperature. Reducing the target catalyst inlet temperature may reduce the amount of power used to keep the catalyst warm. The engine may now be started with a catalyst that may operate more efficiently at the time that the engine is started.

In this way, a catalyst may be heated in a minimum amount of time so that a vehicle may be driven away shortly after a request to start the vehicle is made. The catalyst may be heated in a way that efficiently uses heat that is generated by the catalyst heater. The engine is operated as an air pump to deliver heat energy from the heater to the catalyst.

Referring now to FIG. 3, an example engine operating sequence according to the method of FIGS. 4 and 5 is shown. The sequence of FIG. 3 may be provided via the system of FIG. 1 in cooperation with the method of FIGS. 4 and 5.

The first plot from the top of FIG. 3 is a plot of catalyst inlet temperature versus time. The vertical axis represents catalyst inlet temperature and the catalyst inlet temperature increases in the direction of the vertical axis arrow. The horizontal axis represents time and time increases from the left side of the figure to the right side of the figure. Trace 352 represents the catalyst inlet temperature. Dashed line 350 represents a target catalyst temperature.

The second plot from the top of FIG. 3 is a plot of catalyst temperature versus time. The vertical axis represents catalyst temperature and the catalyst temperature increases in the direction of the vertical axis arrow. The horizontal axis represents time and time increases from the left side of the figure to the right side of the figure. Trace 362 represents the catalyst temperature. Dashed line 350 represents a target catalyst temperature.

At time t10, the catalyst temperature and the catalyst inlet temperature are low (e.g., at ambient air temperature). The engine (not shown) is not operating or rotating and fuel is not being injected into the engine (not shown). There is no indication of an impending engine start, nor is there a request to warm the catalyst in advance of an impending engine start.

At time t11, a request to heat the catalyst with minimal power is generated (not shown). The engine is rotated without fuel being supplied to the engine at a minimum engine speed at which the engine's oil pump generates a threshold pressure to lubricate the engine. The catalyst heater is also activated. The catalyst heater is operated at a power level that generates a target catalyst inlet temperature that is a lower of a specified temperature above the present catalyst temperature (e.g., 2 degrees Celsius above the present catalyst temperature) and the target temperature of the catalyst. This allows the catalyst inlet temperature to be increased gradually so that heated air may have a maximum latency period of time in the catalyst and the catalyst heater so that a maximum amount of energy may be transferred from heated air to the catalyst. The target catalyst inlet temperature is below the target catalyst temperature. The catalyst temperature begins to gradually rise shortly thereafter. The catalyst temperature lags the catalyst inlet temperature.

Between time t11 and time t12, the target catalyst temperature is revised upward as the catalyst temperature increases. This allows the catalyst temperature to migrate toward the target catalyst temperature.

At time t12, the catalyst temperature reaches the target catalyst temperature so the target catalyst inlet temperature is reduced to the target catalyst temperature. Reducing the target catalyst inlet temperature may further reduce the amount of power used to keep the catalyst warm. The engine may now be started with a catalyst that may operate more efficiently at the time that the engine is started.

In this way, a catalyst may be heated via a minimum amount of power so that power may be conserved. This method of catalyst heating may be useful when a vehicle is scheduled to leave for a destination at a predetermined time. The catalyst may be heated before the vehicle is scheduled to leave so that when the vehicle's engine is started, the catalyst may convert engine emissions efficiently.

Referring now to FIGS. 4 and 5, the method 400 may be included in and may cooperate with the system of FIGS. 1 and 2. At least portions of method 400 may be incorporated in the system of FIGS. 1 and 2 as executable instructions stored in non-transitory memory. In addition, other portions of method 400 may be performed via a controller transforming operating states of devices and actuators in the physical world. The controller may employ actuators and sensors described herein adjust catalyst heating operation. Further, method 400 may determine selected control parameters from sensor inputs.

At 402, method 400 judges if the vehicle's engine is off (e.g., not combusting fuel and not rotating) and if catalyst heating is requested. Catalyst heating may be requested based on a scheduled time that an engine is expected to be started (e.g., when a vehicle owner is expected to leave home for work) or an engine start request that has not previously been anticipated. If method 400 judges that the engine is off and catalyst heating is requested, the answer is yes and method 400 proceeds to 404. Otherwise, the answer is no and method 400 proceeds to exit.

At 404, method 400 judges if a minimum catalyst heating time is selected. A minimum catalyst heating time may be selected via a vehicle user when a vehicle trip is unexpected or unplanned. A minimum catalyst heating time may allow the vehicle user to drive the vehicle away at a sooner time than if a minimum power to heat the catalyst is selected. If method 400 judges that a minimum catalyst heating time is selected, the answer is yes and method 400 proceeds to 406. Otherwise, the answer is no and method 400 proceeds to 440.

At 406, method 400 estimates an amount of air flow through the engine for a target catalyst inlet temperature to be reached when a maximum rated amount of power is input to the catalyst heater. In one example, method 400 may estimate the engine air flow amount based on the following equation:

$$\text{Engairflow}=f(\text{Tamb},\text{Pcat},\text{Tcatin},\text{IVC})$$

where Engairflow is the engine air flow, Tamb is the ambient air temperature, Pcat is the amount of power that is input to the catalyst, Tcatin is the target catalyst inlet temperature, IVC is intake valve closing timing, and f is a function that returns engine air flow. Method 400 proceeds to 408.

At 408, method 400 activates the catalyst heater and operates the catalyst heater such that the catalyst heater may consume a maximum amount of energy so that the catalyst heater may generate a maximum temperature. In other words, the catalyst heater may be operated at substantially full or maximum rated input power (e.g. within 15% of the catalyst heater's maximum power input level) of the catalyst heater to increase catalyst temperature. For example, a catalyst heater may have a maximum input power limit of 300 watts. Therefore, 300 watts of electrical power or chemical power may be supplied to the catalyst heater to increase a temperature of air that may pass through the catalyst heater. Method 400 proceeds to 410.

At 410, method 400 adjusts engine poppet valve timing based on the estimated engine air flow rate needed to generate the target catalyst inlet temperature. In one example, method 400 may reference a table or function that outputs intake valve closing timing when the table or function is referenced using the estimated engine air flow rate. Method 400 may also fully open the engine's throttle so as to reduce engine pumping work. Method 400 may also rotate the engine with poppet valves of some engine cylinders being deactivated such that poppet valves in deactivated cylinders are held open during an entire engine cycle or so that poppet valves are held closed during an entire engine cycle. Thus, fewer than all engine cylinders may be used to pump air through the engine. This may further reduce an amount of energy that may be used to rotate the engine. The timing of poppet valves in cylinders that are functioning as air pumps along with engine speed may be adjusted to control air flow through the engine. For example, if a catalyst inlet temperature is less than a target catalyst inlet temperature, intake valve closing timing may be retarded from its present timing so that less air may flow through the engine. The lower air flow may increase an amount of time that heat may be transferred from catalyst heater to air that passes through the catalyst, thereby increasing the catalyst inlet temperature. Similarly, if a catalyst inlet temperature is greater than a target catalyst inlet temperature, intake valve closing timing may be advanced from its present timing so that more air may flow through the engine so that there may be less time to heat air that is passing through the catalyst heater. Method 400 proceeds to 412.

At 412, method 400 rotates the engine without supplying fuel to the engine. The engine may be rotated via an electric machine. The electric machine may be a conventional starter motor or an electric machine that may supply power to the vehicle's driveline (e.g., 52 of FIG. 1). In one example, method 400 may rotate the engine at a minimum speed that delivers the target catalyst inlet temperature. The target catalyst inlet temperature may be a temperature at which a phase change material changes phase. For example, if the phase change material changes phase from a solid phase to a liquid phase at 700° C., the target temperature may be a value that is based on the 700° C. temperature. In another example, the target temperature may be a temperature that is within a threshold temperature of a maximum rated catalyst temperature (e.g., within 20° C. of 900° C., where 900° C. is a maximum rated temperature of an example catalyst). Initially, the engine may be rotated at a speed that is expected to deliver the air flow estimated at 406. The rotational speed of the engine may be adjusted according to the temperature of air at the catalyst inlet as mentioned below. Method 400 proceeds to 414.

At 414, method 400 judges if a temperature at an inlet of the catalyst is greater than a first target catalyst inlet temperature. The first target catalyst inlet temperature may be below the second target catalyst inlet temperature. If method 400 judges that the temperature at the inlet of the catalyst is above the first target catalyst inlet temperature, the answer is yes and method 400 proceeds to 430. Otherwise, the answer is no and method 400 proceeds to 416.

At 416, method 400 reduces air flow through the engine so that a temperature of air flowing through the catalyst heater may increase, thereby increasing air temperature at the inlet of the catalyst. The air flow through the engine may be reduced via reducing engine speed, reducing an actual total number of cylinders that are pumping air through the engine, and/or advancing intake valve closing timing after bottom-dead-center intake stroke. The engine speed may be a minimum speed that the engine rotates when the engine's oil pump generates a threshold oil pressure. Method 400 proceeds to 418.

At 430, method 400 judges if a temperature at an inlet of the catalyst is greater than a second target catalyst inlet temperature. If method 400 judges that the temperature at the inlet of the catalyst is above the second target catalyst inlet temperature, the answer is yes and method 400 proceeds to 432. Otherwise, the answer is no and method 400 proceeds to 418.

At 432, method 400 increases air flow through the engine so that a temperature of air flowing through the catalyst heater may decrease, thereby decreasing air temperature at the inlet of the catalyst. The air flow through the engine may be decreased via increasing engine speed, increasing an actual total number of cylinders that are pumping air through the engine, and/or retarding intake valve closing timing to before bottom-dead-center intake stroke. Method 400 proceeds to 418.

At 418, method 400 judges if the catalyst is within a threshold temperature (e.g., 10° C.) of a target catalyst temperature. If so, the answer is yes and method 400 proceeds to 420. Otherwise, the answer is no and method 400 returns to 414.

At 420, method 400 reduces a temperature at the inlet of the catalyst to the target catalyst temperature via reducing an amount of power that is delivered to the catalyst heater. For example, an amount of electric power that is delivered to the catalyst heater may be reduced from 300 watts to 180 watts. By reducing the amount of power that is delivered to the catalyst heater, the temperature of the catalyst may be maintained without consuming larger amounts of power. In one example, the target temperature of the catalyst may be a temperature at which a phase change material changes phase. In another example, the target temperature may be a temperature at which the catalyst may operate with a threshold efficiency (e.g., greater than 90% efficiency). Method 400 proceeds to 422.

At 422, method 400 judges if an engine start has been requested or if a threshold amount of time has passed since the catalyst most recently reached the target catalyst temperature. If so, the answer is yes and method 400 proceeds to 424.

At 424, method 400 adjusts timing of engine poppet valves to a base timing. In addition, method 400 may judge if engine speed is at a requested speed. If not, method 400 may increase or decrease engine speed so that the engine is at the requested speed. Method 400 proceeds to 426.

At 426, method 400 starts the engine if an engine start is requested. The engine may be started via supplying fuel to the engine. Spark may also be supplied to the engine if the engine is a gasoline engine. Method 400 proceeds to 428.

At 428, method 400 ceases rotating the engine via the electric machine once combustion begins in the engine. Method 400 may also stop supplying power to the catalyst heater. Method 400 proceeds to exit.

At 440, method 400 determines a requested engine start time. The requested engine start time may be retrieved from a human/machine interface, a cloud server, or other device. In one example, a user may input a requested engine starting time into a human/machine interface and the vehicle and engine may be prepared to start at the requested engine start time. Method 400 proceeds to 442.

At 442, method 400 estimates an amount of time it may take to heat the catalyst to a target temperature. In one example, method 400 may reference a table or function that outputs an amount of time based on a present temperature of the catalyst and ambient air temperature. Values in the table or function may be empirically determined and the functions may be stored in controller read-only memory. Method 400 estimates the amount of time that it will take to heat the catalyst and proceeds to 444.

At 444, method 400 delays heating of the catalyst to a time that is equal to the requested engine starting time minus the amount of time to heat the catalyst as determined at 442. For example, if the engine is expected to be started at 7:00 A.M. and the amount of time to heat the catalyst is expected to be 20 minutes, then method 400 begins heating the catalyst at 6:40 A.M. Method 400 proceeds to 446 when the present time is equal to the expected engine starting time minus the amount of time it is expected to take to heat the catalyst to the target catalyst temperature via a minimum power to heat the catalyst strategy.

At 446, method 400 rotates the engine without supplying fuel to the engine. In addition, method 400 may adjust engine poppet valve timing and rotate the engine with the engine's throttle fully open. In one example, the engine is rotated at a lowest speed at which the engine's oil pump generates a minimum threshold oil pressure. This speed may be well below the engine idle speed. The minimum threshold pressure may be a pressure that adequately lubricates the engine. The poppet valve timings may be determined via referencing a table or function according to ambient air temperature and the target catalyst inlet temperature. Method 400 proceeds to 448.

At 448, method 400 adjusts an amount of power that is supplied to the catalyst. In particular, the amount of power that is provided the catalyst heater may be increased if the catalyst inlet temperature is less than a target catalyst inlet temperature. In one example, the target catalyst temperature may be equal to the lower of the present catalyst temperature plus a predetermined offset temperature (e.g., 2° C.) or the target catalyst temperature. If the catalyst includes a phase change material, the target temperature may be based on a temperature at which the phase change material changes phase. In this way, the target catalyst temperature may be adjusted according to a present temperature of the catalyst. If the catalyst inlet temperature is less than the target catalyst inlet temperature, the amount of power that is provided to the catalyst heater is increased. In this way, the catalyst temperature may be gradually increased by transferring heat from air that is entering the catalyst to the catalyst. Method 400 proceeds to 450.

At 450, method 400 judges if a temperature of the catalyst is within a threshold temperature of a target catalyst temperature. In one example, the target catalyst temperature is a temperature at which the catalyst may have a threshold efficiency level. In another example, the target catalyst temperature may be a temperature at which a phase change material changes phase. If method 400 judges that the temperature of the catalyst is within the threshold temperature (e.g., 2° C.) of the target catalyst temperature, the answer is yes and method 400 proceeds to 452. Otherwise, the answer is no and method 400 returns to 448.

At 452, method 400 lowers the amount of power that is supplied to the catalyst heater so that a temperature at the inlet of the catalyst is equal to the target catalyst temperature. For example, if the catalyst heater is an electric heater, method 400 may reduce an amount of electric power that is provided to the catalyst heater from 150 watts to 120 watts. In one example, the target temperature of the catalyst may be a temperature at which a phase change material changes phase. In another example, the target temperature may be a temperature at which the catalyst may operate with a threshold efficiency (e.g., greater than 90% efficiency). In addition, method 400 may adjust engine poppet valve timing so that the temperature at the inlet of the catalyst is equal to the target catalyst temperature. For example, method 400 may advance intake valve closing timing to reduce air flow through the engine. Method 400 proceeds to 454.

At 454, method 400 judges if an engine start has been requested or if a threshold amount of time has passed since the catalyst most recently reached the target catalyst temperature. If so, the answer is yes and method 400 proceeds to 456.

At 456, method 400 adjusts timing of engine poppet valves to a base timing. Method 400 may also increase or decrease engine speed so that the engine speed is at a requested engine speed for engine starting. Method 400 proceeds to 458.

At 458, method 400 starts the engine if an engine start is requested. The engine may be started via supplying fuel to the engine. Spark may also be supplied to the engine if the engine is a gasoline engine. Method 400 proceeds to 460.

At 460, method 400 ceases rotating the engine via the electric machine once combustion begins in the engine. Method 400 may also stop supplying power to the catalyst heater. Method 400 proceeds to exit.

In this way, method 400 may increase a temperature of a catalyst prior to an automatic engine start so that engine emissions may be efficiently converted when the engine is started. The catalyst may be heated to a target in a minimum amount of time or with a minimum amount of power. Additionally, the engine may act as an air pump to distribute heated air from a catalyst heater to the catalyst.

Thus, the method of FIG. 4 provides for a method for operating an engine, comprising: activating a catalyst heater (e.g., an electrically powered catalyst heater) in an engine exhaust system and operating the electrically driven heater at substantially full power; rotating an engine without supplying fuel to the engine; and adjusting an amount of air flow through the engine such that a target temperature is achieved at an inlet of a catalyst. The method includes where the target temperature is based on a temperature at which a phase change material changes phase. The method includes where the target temperature is a maximum rated temperature of the catalyst. The method includes the engine is rotated with a throttle of the engine open more than 50% open. The method further comprises adjusting valve timing of one or more cylinders to achieve the target temperature. The method further comprises rotating the engine with poppet valves of one or more cylinders deactivated in an open state. The method further comprises rotating the engine with poppet valves of one or more cylinders deactivated in a fully closed state.

The method of FIG. 4 also provides for a method for operating an engine, comprising: rotating an engine at a speed that an oil pump of the engine delivers a minimum threshold pressure without supplying fuel to the engine in response to a catalyst heating request; and adjusting an amount of power (e.g., electrical power) delivered to a catalyst heater to generate a target temperature at an inlet of a catalyst, the target temperature at the inlet of the catalyst being a lower value of a target catalyst temperature and a present catalyst temperature plus an offset temperature. The method further comprises adjusting the target temperature to a temperature that is based on a temperature at which a phase change material changes phase once a temperature of the catalyst reaches a target temperature. The method further comprises adjusting air flow through the engine as a function of ambient air temperature. The method further comprises adjusting an actual total number of cylinders delivering air to the catalyst heater in response to the catalyst heating request. The method further comprises adjusting engine poppet valve timing in response to the catalyst heating request.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example examples described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific examples are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for operating an engine, comprising:

activating a catalyst heater in an engine exhaust system and operating the catalyst heater at substantially full power;

rotating an engine without supplying fuel to the engine; and adjusting an amount of air flow through the engine such that a target temperature is achieved at an inlet of a catalyst.

2. The method of claim 1, where the target temperature is based on a temperature at which a phase change material changes phase.

3. The method of claim 1, where the target temperature is a maximum rated temperature of the catalyst.

4. The method of claim 1, where the engine is rotated with a throttle of the engine open more than 50% open.

5. The method of claim 4, further comprising adjusting valve timing of one or more cylinders to achieve the target temperature.

6. The method of claim 1, further comprising rotating the engine with poppet valves of one or more cylinders deactivated in an open state.

7. The method of claim 1, further comprising rotating the engine with poppet valves of one or more cylinders deactivated in a fully closed state.

8. A system for operating an engine, comprising:

an internal combustion engine including a catalyst and a catalyst heater; and a controller including executable instructions stored in non-transitory memory that cause the controller to minimize an amount of time to heat a catalyst to a threshold temperature in a first mode, and additional instructions that cause the controller to minimize an amount of power to heat the catalyst to a threshold temperature in a second mode, the amount of time minimized by adjusting an amount of air flow through the internal combustion engine while operating the catalyst heater with a substantially constant amount of electrical power.

9. The system of claim 8, where the amount of power is minimized via adjusting a target catalyst inlet temperature based on a present catalyst temperature.

10. The system of claim 9, where amount of power is minimized via rotating the engine at a speed that is below an engine idle speed.

11. The system of claim 8, further comprising additional instructions to adjust a target catalyst inlet temperature based on a temperature at which a phase change material changes phase.

12. The system of claim 8, where the first mode and the second mode may be selected via a user input.

13. The system of claim 8, where the amount of air is adjusted to produce a target temperature at an inlet of the catalyst.

14. The system of claim 8, where the substantially constant amount of electrical power is a maximum rated power of the catalyst heater.

15. The system of claim 8, further comprising additional instructions to adjust a target temperature at an inlet of the catalyst after the catalyst reaches a threshold temperature to a temperature that is based on a property of a phase changing material.

16. A method for operating an engine, comprising:

rotating an engine at a speed that an oil pump of the engine delivers a minimum threshold pressure without supplying fuel to the engine in response to a catalyst heating request; and adjusting an amount of power delivered to a catalyst heater to generate a target temperature at an inlet of a catalyst, the target temperature at the inlet of the catalyst being a lower value of a target catalyst temperature and a present catalyst temperature plus an offset temperature.

17. The method of claim 16, further comprising adjusting the target temperature to a temperature that is based on a temperature at which a phase change material changes phase once a temperature of the catalyst reaches a target temperature.

18. The method of claim 16, further comprising adjusting air flow through the engine as a function of ambient air temperature.

19. The method of claim 16, further comprising adjusting an actual total number of cylinders delivering air to the catalyst heater in response to the catalyst heating request.

20. The method of claim 16, further comprising adjusting engine poppet valve timing in response to the catalyst heating request.

* * * * *